US005343266A

United States Patent [19]

Pummell et al.

[11] Patent Number: 5,343,266

[45] Date of Patent: Aug. 30, 1994

[54] FILM EXTRACTION UNIT

[75] Inventors: Leslie J. H. Pummell, Rickmansworth; Paul C. Ward, Oxhey; Stephen J. Kingdon, St. Albans; James A. Oldfield, Nags Head Lane, all of United Kingdom

[73] Assignee: Eastman Kodak Company, Rochester, N.Y.

[21] Appl. No.: 36,563

[22] Filed: Mar. 24, 1993

[30] Foreign Application Priority Data

Mar. 24, 1992 [GB] United Kingdom ..... 9206347

[51] Int. Cl.[5] ..... G03D 13/08; G03D 13/10

[52] U.S. Cl. ..... 354/340; 354/345; 226/25; 226/43; 242/563; 242/564

[58] Field of Search ..... 354/275, 311, 312, 313, 354/314, 319–321, 345; 226/24, 25, 11, 40, 42; 242/36, 46.2, 190, 57, 56; 318/282–287

[56] References Cited

U.S. PATENT DOCUMENTS

| | | | |
|---|---|---|---|
| 2,945,429 | 7/1960 | Grant | 95/94 |
| 3,178,124 | 4/1965 | Trout et al. | 242/56 |
| 3,264,970 | 8/1966 | Hersh et al. | 95/94 |
| 3,411,612 | 11/1968 | Richmond | 192/139 |
| 3,774,538 | 11/1973 | Bullock | 101/336 |
| 3,969,982 | 10/1972 | Gottschall | 226/25 |
| 4,304,484 | 12/1981 | Mizuta et al. | 354/321 |
| 4,309,100 | 1/1982 | Bendoni et al. | 354/303 |
| 4,344,073 | 8/1982 | Rawlings | 340/675 |
| 4,543,151 | 9/1985 | Aldo | 156/502 |
| 4,572,636 | 2/1986 | Konno | 354/173.11 |
| 4,598,618 | 7/1986 | Kuchler | 83/77 |
| 4,605,456 | 8/1986 | Annis, Jr. | 156/157 |
| 4,641,067 | 2/1987 | Iizawa et al. | 318/287 |
| 4,645,323 | 2/1987 | Stella | 354/303 |
| 4,746,845 | 5/1988 | Mizuta et al. | 318/286 |
| 4,791,443 | 12/1988 | Foley et al. | 354/321 |
| 4,852,785 | 8/1989 | Bettendorf et al. | 226/42 |
| 4,855,653 | 8/1972 | Lemirande | 318/282 |
| 4,929,297 | 5/1990 | Sato | 242/58.1 |

FOREIGN PATENT DOCUMENTS 3244503 9/1983 Fed. Rep. of Germany .

*Primary Examiner*—D. Rutledge

*Attorney, Agent, or Firm*—Frank Pincelli

[57] ABSTRACT

Described herein is a film extraction unit for use in a loading device for photographic processing apparatus. The unit comprises an unloading station (12) into which a film cassette (100) is positioned with the film leader extending therefrom to lie between rollers (26, 28). Roller (26) is a pinch roller which engages with drive roller (28) to transport the film out of its cassette. Drive roller (28) is driven by a motor via a clutch arrangement so that once all the film (102) has been extracted from the cassette (100), the clutch will slip allowing the motor to continue to rotate whilst the drive roller (28) becomes stationary, thereby preventing damage to the film (102).

3 Claims, 2 Drawing Sheets

FILM EXTRACTION UNIT

FIELD OF THE INVENTION

This invention relates to film extraction units and is more particularly concerned with a film unloading device for use with photographic processing apparatus in which such a unit is utilized.

BACKGROUND INFORMATION

Most photographic film now used is 35 mm format film. Cameras have been developed to allow film of this format to be easily loaded by placing the film cassette, in which the film is stored, into an opening in the back of the camera and then shutting the back of the camera. As a free end or tongue of the film extends externally to the film cassette, this is used to automatically advance the film in the camera for picture taking. Once all the pictures have been taken, the film is rewound into the film cassette for removal from the camera for processing. In order for this to work, the free end or tongue of the film must extend externally to the cassette so that it can be pulled on to the take-up spool in the camera as the film is first loaded.

Photographic film tends to be processed in a single strip once the film has been removed from its cassette. Strips of negative film are processed by transporting them, either as a single individual strip or as a continuous length comprising two or more strips of shorter lengths, through a series of processing solutions in various tanks in the processing apparatus.

In known processing apparatus, the film strip is pulled through tanks containing the processing solutions either by a leader which is attached to the leading edge of the film strip, or by moving a rack or spiral containing the film strip from tank to tank. Individual film strips may be pre-spliced into a long reel with a leader card at the front end, clipped to a rack, or fed into a spiral.

Where the film strip is attached to a leader, it is unloaded from the cassette and attached to the leader in a manual operation. The leader is then fed into the processing apparatus so that the film can be processed as it is transported through the apparatus.

Operations of splicing the film strips together or attaching the leader to the strip need to be carried out in darkroom conditions due to the sensitive nature of the film.

However, in some processing apparatus, there is a minimum length of film strip which can be processed. As a result, several film strips need to be spliced together prior to processing. This may be time-consuming as each strip will need to be measured to ensure that the minimum processing length is present in the spliced strip prior to processing.

In order to overcome the problems mentioned above, a loading device for a photographic processing apparatus in which the film strip is automatically unloaded from its cassette, its length checked, and then fed into the processor if the film strip exceeds the minimum length under the control of the process computer is provided. In this arrangement, a motor is used to provide drive to a pair of rollers to remove the film from its cassette. However, it is known to use a motor to advance and rewind film in a camera, the motor being either integral with the camera or a separate attachment. One such arrangement in which a separated attachment is used is disclosed in U.S. Pat. No. 4,118,659.

U.S. Pat. No. 4,322,149 discloses a device in which a motor is used to wind up a film. A wind-up signal is produced when an exposure has been completed which drives the wind-up motor. The torque produced by the motor is detected and an increase in torque corresponding to the completion of the wind-up produces a signal to inactivate the motor.

In U.S. Pat. No. 4 383 747, a clutch mechanism is used to transmit the driving power of an electric motor to wind up a photographic film on a spool. This allows the film to be driven frame by frame as the shutter mechanism of the camera is charged ready for the next exposure.

A fully automated camera is disclosed in U.S. Pat. No. 4,506,965 which is capable of a film winding operation during exposure of the film to be changed to film rewinding operation when the end of the film is detected. This is achieved using a one-way coupling mechanism which allows transmission of drive from a winding shaft to a spool during the winding operation, and which disconnects this drive during the rewinding operation. The point at which the drive is disconnected for the rewinding operation is determined by sensing that the film tension has exceeded a predetermined value.

U.S. Pat. No. 4,465,351 describes a motor-operated film driving device in which the driving circuit for the motor can be switched between one of three states, a first state in which the motor is driven forward for film winding, a second state in which the motor is short-circuited and a third state in which the motor is driven in reverse for film rewinding. Detection of a predetermined value of film tension changes the motor from the first to the second state and also generates a delay signal, the motor being changed from the second to the third state in response to the delay signal.

In another arrangement, as described in U.S. Pat. No. 4,419,001, automatic switching between modes is achieved when an increase in motor current is detected on completion of the film wind-up. A member is moved from one position to another on detection of the increased motor current to allow film rewind.

U.S. Pat. No. 4,166,239 discloses another arrangement in which motor current is detected for control of a film drive motor. In this arrangement, a load increase on the motor corresponding to an increase in the tension of the film as its end is reached, in either winding or unwinding modes, causes the motor power supply circuit to be opened stopping movement of the film and thereby preventing damage.

Although it is well-known to used motors to advance and rewind film in cameras as described above, motor current sensing is only used as an indication that the end of the film has been reached, the film being rewound back into its cassette, or that the film is snagging in the camera.

SUMMARY OF THE INVENTION

According to one aspect of the present invention, there is provided a film extraction unit for extracting a film strip from its cassette, the unit comprising:

support means for supporting the cassette as the film strip is extracted;

engagement means for engaging the film strip and drawing it out of the cassette;

drive means for driving the engagement means; and control means for controlling the drive means;

characterized in that the drive means comprises a motor and a clutch arrangement, the clutch arrangement transmitting drive to the engagement means and being arranged to slip as the motor current rises as the film is fully extracted.

By this arrangement, the motor continues to rotate whilst the drive roller is stationary so that damage to the film strip is prevented as its end is reached.

BRIEF DESCRIPTION OF THE DRAWINGS

For a better understanding of the present invention, reference will now be made, by way of example only, to the accompanying drawings in which.

DESCRIPTION OF THE PREFERRED EMBODIMENT

Figure 1:
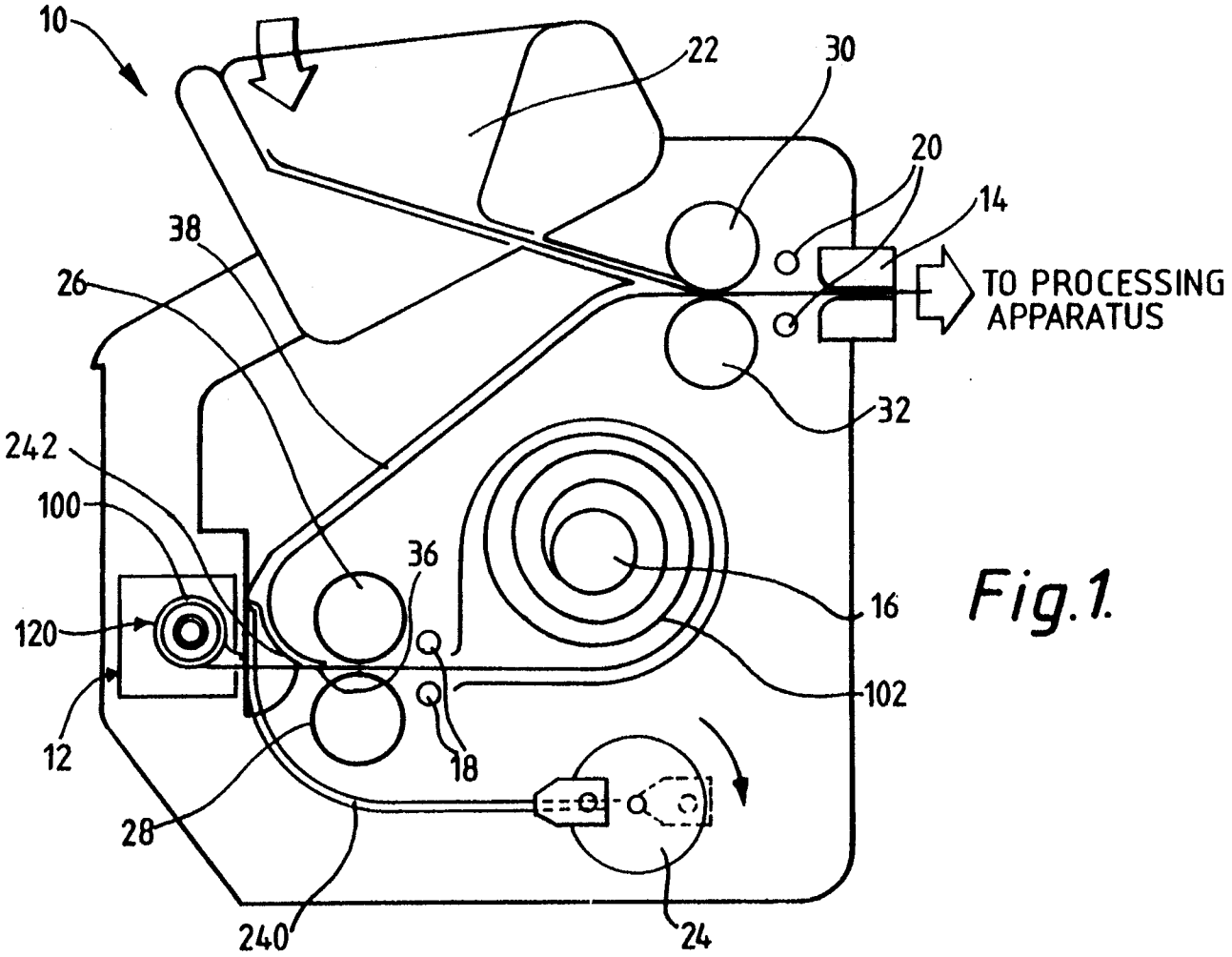
FIG. 1 illustrates a schematic side elevation of a loading device incorporating a film extraction unit in accordance with the present invention.

The device 10 shown in FIG. 1 comprises a cassette unloading station 12, a film delivery station 4 connected to processing apparatus (not shown), a storage station 16, a film length checking station 18, a film position checking station 20, a direct film loading station 22, and a cutting station 24. Pairs of transport rollers 26, 28 and 30, 32 are provided to transport the film through the device 10. These rollers are driven by one or more motors (not shown).

At the cassette unloading station 12, a film cassette 100 is positioned in a cassette-shaped aperture 120 with a free end of the film, otherwise called the film leader or the tongue, extending through the cassette wall. The length of the film leader or tongue is determined by a guide (not shown) which is positioned on the outside of the device 10. A slot (not shown) is arranged in the casing of the device 10 so that the film leader can be introduced into the device 10 and positioned between transport roller pair 26, 28, which are initially spaced apart.

Once the cassette 100 is loaded into the cassette unloading station 12 and the film leader is positioned between roller pair 26, 28, the device 10 can be operated and unloading of the film from its cassette can take place.

Roller 26 is a pinch roller which is movable between a first position in which it is not in contact with roller 28, and a second position in which it is in contact with roller 28. The roller 26 is moved between these two positions by a first motor (not shown).

Roller 28 is a drive roller and is driven by a second motor (also not shown). A clutch arrangement (not shown) is associated with roller 28 and the second motor, the clutch slipping when all the film 102 has been unwound from its cassette 100 to prevent the motor stalling. Operation of the cutting station 24 is then initiated.

Once the cassette 100 is correctly positioned as discussed above, i.e. with the film leader positioned between rollers 26, 28, the first motor operates to move roller 26 against roller 28. The second motor then operates to drive roller 28 and the film 102 is pulled out of its cassette 100 and into the storage station 16, along a first film path 36 which extends between the cassette unloading station 12 and the storage station 16, by roller 28 acting against roller 26. The slot in the casing of the device 10, as mentioned above, is located to coincide with at least the portion of the first film path 36 with extends between the cassette unloading station 12 and the transport rollers 26, 28 are arranged along this path 36.

As the film is unwound from its cassette 100, it is transported along path 36 and into storage station 16, its length is checked by the film length checking station 18. This station comprises a pair of spaced apart sensors (not shown in detail) to count or detect the presence of perforations or sprocket holes in the film 102.

Once all the film 102 has been unwound from the cassette 100, the second motor (34) is inactived and drive to the roller 28 is shut down. The cutting station 24 then comes into operation. This station comprises a guillotine blade 240 driven by a third motor and associated gearbox (not shown) to move in an upwardly direction from the base of the device 10. The blade 240 is rotated through an angle of 180° by the third motor, and in so doing, cuts through the film 102 at a position adjacent the film unloading station 12 to release it from the spool (not shown) to which it is attached inside the cassette 100. The guillotine blade 40 carries a guide 242 adjacent its cutting edge as shown.

Once the film has been cut, the cassette 100 can be discarded from the unloading station 12 and recycled as desired.

It is to be noted that film 102 is not all wound into the storage station 16 as roller 28 is inactivated prior to operation of the cutting station 24. This means that there is a portion of the film 102 adjacent the newly severed leading edge which is trapped between roller pair 26, 28.

Provided the length of the film exceeds a minimum predetermined value as measured by the film length checking station 18, the second motor (34) is activated once more in the opposite direction so that roller 28, in conjunction with pinch roller 26, will then transport the film 102, with its newly severed end leading, along second film path 38 towards the other pair of transport rollers 30, 32.

The second film path 38 includes the first film path 36, but the film 102 is driven along it in the opposite direction. The guide 242 attached to the guillotine blade 240 acts to direct the film 102 from the first film path 36 upwardly into the upper portion of the second film path 38.

Transport roller pair 30, 32 comprises a pinch roller 30 and a drive roller 32 in similar fashion to transport roller pair 26, 28. As the film 102 is driven towards roller pair 30, 32, the pinch roller 30 is spaced away from the drive roller 32 and the newly severed leading edge of the film leader can pass therebetween up to the film position checking station 20. Once the presence of the film 102 has been sensed at the checking station 20, the second motor (34) is inactivated and a fourth motor operates to bring the pinch roller 30 into contact with drive roller 32.

The first motor (33) is then operated to lift roller 26 off roller 28 so that the film 102 can be controlled from the roller pair 30, 32.

When the control system of the processing apparatus asks for the film 102, drive is provided to drive roller 32 by a fifth motor (not shown). The film 102 is then driven to the film delivery station 14 for entry into the processing apparatus.

Once the leading edge of the film 102 has been engaged by the drive system of the processing apparatus, the fourth motor operates to lift pinch roller 30 off drive roller 32 and allows the movement of the film to be controlled by the processing apparatus.

Once all the film has been delivered to the processing apparatus, drive to drive roller 30 is stopped, and the guillotine blade 240 is then returned to its rest position in the device 10 by rotating it through a further 180° under the control of the third motor.

After passing between rollers 30, 32, the film length may be checked again at the film position checking station 20 prior to the film being driven through the film delivery station 14 and into the processing apparatus.

The roller pair 30, 32 and the film position checking station 20 may have an additional function, namely, that of transporting and checking the length of film strips which are introduced manually into the direct loading station 22.

Figure 2:
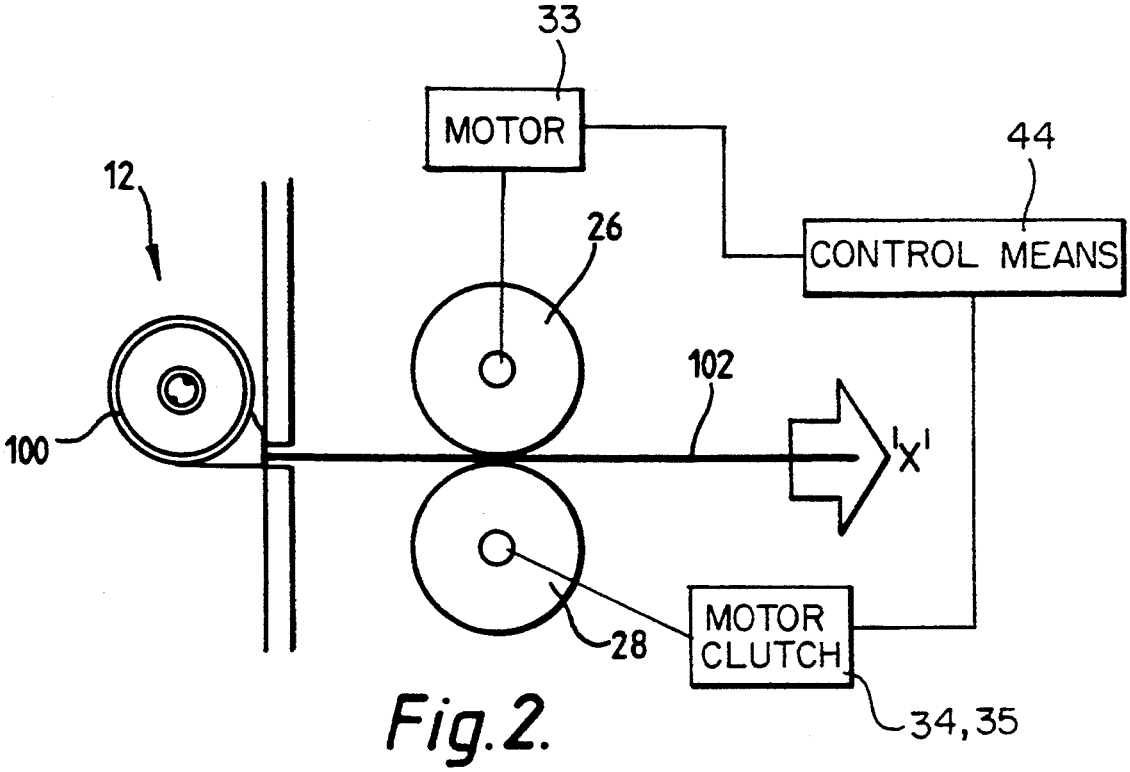
FIG. 2 is an enlarged schematic side elevation of the film extraction unit.

As shown in FIG. 2, the cassette 100 is held in the unloading station 12 with the film 102 extending therefrom so that its leader extends between rollers 26, 28. As described above, roller 26 is a pinch roller operable by a motor (33) to move into and out of contact with roller 28. Roller 28 is a drive roller and operates, in conjunction with roller 26, to pull the film out of the cassette 100. Roller 28 is driven by the second motor (34) via a clutch arrangement (35) which slips when all the film 102 has been unwound from the cassette 100 to prevent the motor stalling (as describe above).

Figure 3:
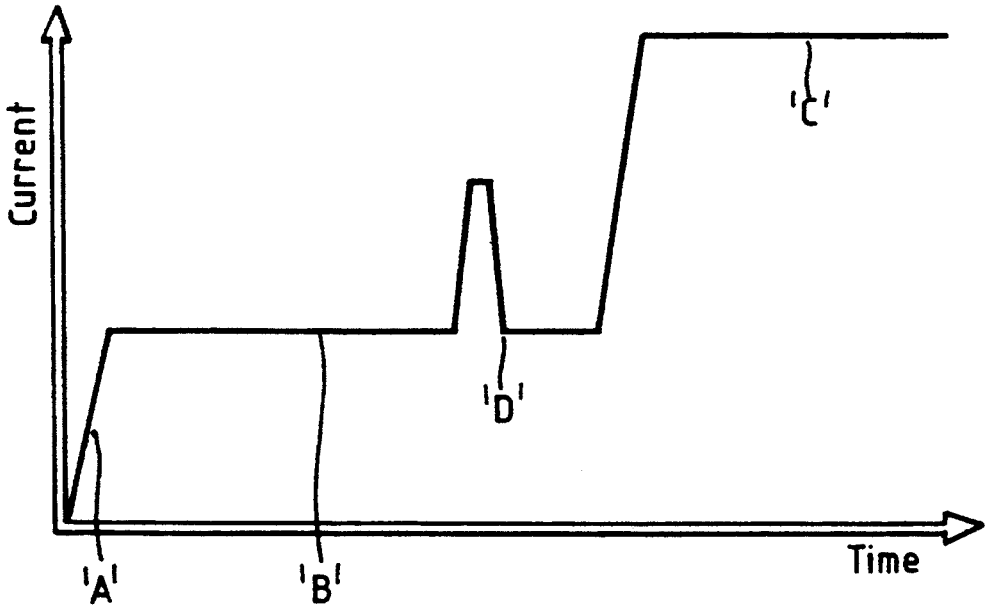
FIG. 3 is a graph showing current as the film is extracted from its cassette.

As the film 102 is unwound from its cassette 100, in the direction of arrow 'X', and into the storage station (not shown), the current in the motor varies according to the load put on the motor by the film. FIG. 3 shows a plot of the motor current against time as the film 102 is extracted from its cassette 100.

As shown in FIG. 3, there are several stages during extraction of the film, each stage being defined by a portion of the current curve. By monitoring the motor current corresponding to the curve, control means (44) for the loading device can then operate the cutting station when required.

During stage 'A', the motor is started and the current increases until the film is tensioned. Stage 'B' represents the normal pulling tension as the film is drawn out of its cassette. Stage 'C' represents the end of the film which results in a current peak due to the film tension. At this point, the clutch will slip disconnecting the drive roller from the motor preventing damage to the film. The motor will continue to rotate whilst the drive roller 28 is held stationary, and the motor is still rotating, the high current produced is shared by all the windings.

Any increase in film tension however caused, may produce a sharp, instantaneous rise in the motor current as shown by stage 'D'. This increase may be caused by stiffness in the velvet light lock at the entrance to the cassette, or by damaged film. The control means (discussed above) is programmed or designed to ignore this increase where appropriate.

The film extraction device according to the present invention has the following advantages:

a) the (computer) control circuitry can monitor the motor current and hence the film tension during the whole of the film extraction, without danger of motor overload.

b) short term increases of tension can be distinguished from long term tension built up at the end of film extraction.

c) the slipping clutch protects the motor from excessive current passing through its coils at the end of film extraction.

d) because the drive roller is stationary at the end of film extraction, there is no danger of damage to the film surface, as would be the case if the roller were to rotate against stationary film.

The extraction device of the present invention can be used in any situation where an object is pulled against a dead stop, but where occasional increases in pulling tension are experienced.

We claim:

1. A film extraction unit for extracting a film strip from its cassette, the unit comprising:

support means for supporting the cassette as the film strip is extracted;

engagement means for engaging the film strip and drawing it out of the cassette;

drive means for driving the engagement means; and control means for controlling the drive means;

characterized in that the drive means comprises a motor and a clutch arrangement, the clutch arrangement transmitting drive to the engagement means and being arranged to slip as the motor current rises as the film is fully extracted, the control means is operable to monitor a motor current and to distinguish between short term effects and long term effects on the motor current.

2. A unit according to claim 1, wherein the engagement means comprises a first roller driven by the drive means and a second roller operable to hold the film strip against the first roller during extraction.

3. A unit according to claim 1, further including severing means for severing the films strip from its cassette when fully extracted.

* * * * *